United States Patent [19]

Van Denend

[11] Patent Number: 4,756,091

[45] Date of Patent: Jul. 12, 1988

[54] HYBRID HIGH-VELOCITY HEATED AIR/INFRA-RED DRYING OVEN

[76] Inventor: Herbert Van Denend, 270 Goffle Hill Rd., Hawthorne, N.J. 07506

[21] Appl. No.: 66,117

[22] Filed: Jun. 25, 1987

[51] Int. Cl.[4] ..... F26B 3/30

[52] U.S. Cl. ..... 34/4; 34/41; 34/68; 219/354; 219/358; 219/343; 219/405; 219/411; 219/388

[58] Field of Search ..... 34/4, 41, 68, 48; 219/354, 358, 343, 347, 405, 411, 388

[56] References Cited

U.S. PATENT DOCUMENTS

| | | | |
|---|---|---|---|
| 3,720,002 | 3/1973 | Martin | 34/41 |
| 4,103,277 | 7/1978 | Griffin et al. | 219/354 |
| 4,336,279 | 6/1982 | Metzger | 34/41 |
| 4,531,047 | 7/1985 | Canfield et al. | 219/347 |
| 4,665,627 | 5/1987 | Wilde et al. | 34/41 |

*Primary Examiner*—Larry I. Schwartz
*Attorney, Agent, or Firm*—Siegmar Silber

[57] ABSTRACT

A hybrid oven for drying a coating on a continuous web is disclosed, including a chamber, a plenum for collecting and delivering heated air at high velocity adjacent said chamber, a plurality of air impingement nozzles interconnecting said plenum and said chamber and directing heating air from the plenum to the web being dried, and one or more controllable infra-red heaters disposed between said air nozzles including at least one infra-red element, a sensor for providing a control signal relative to temperature and controller means for controlling power to the infra-red element. The sensor senses that the infra-red element is operating at less than a predetermined temperature and is providing less than a required infra-red output, whereby the controller provides a higher voltage until the predetermined infra-red output is reached.

14 Claims, 2 Drawing Sheets

HYBRID HIGH-VELOCITY HEATED AIR/INFRA-RED DRYING OVEN

BACKGROUND OF THE INVENTION

1. Field of the Invention

This invention relates to a hybrid, high-velocity heated or ambient air impingement oven with infra-red elements impingement nozzles. More particularly the invention relates to both the apparatus for and method of use of drying ovens for processing continuous webs such as paper, film, foil, textiles, and metal strips which are either self-supporting or conveyorized. Of further interest, the control mechanism and the regimen therefor is shown and described.

2. Disclosure of the Prior Art

In recent years, environmental concerns have fostered a shift away from organic-solvent-based coatings and adhesives and toward water-based coatings and adhesives. The shift, while lessening the dependence upon petroleum-derived products, has complicated drying oven applications and has spawned technically advanced oven control systems.

One drawback to the change to water-based coatings is the concomitant requirement of increased total drying energy and increased dwell time in the drying oven. However, in many cases the hybridization of the drying ovens, as described herein, not only has maintained the production line arrangement without adding longer conveyorized ovens, but also has even increased the processing rate of coated continuous webs.

Although no pre-examination patentability search was performed, the inventor hereof is engaged in the manufacture of drying ovens, and cites as a reference the catalog of drying and curing ovens, heaters and controls which the manufacturing organization has published. The catalog, that of Glenro, Inc., is in the *Thomas Register,* Vol. 15 (Thomas, NY.1984) pp. 3093–3116. Further, prior art specific to the radiant efficiency of the infra-red source is the reference of A. N. Pargellis "Using a calorimeter and spectrometer to measure radiant efficients of infrared sources" in the *Review of Scientific Instruments,* Vol. 57, No. 1 (January, 1986) pp. 94–98.

SUMMARY

A hybrid high-velocity (4000 feet per minute and above) heated air/infra-red drying oven is disclosed which serves in processing of continuous webs of paper, film, foil, textiles and metal strips. Although, in the specific application described, these webs have been coated on one-side with a solids and solvent-based mixture having high solids content, the disclosure is applicable to processing webs coated on both sides.

With the hybrid arrangement of gas-heated air and infra-red radiation, the drying oven has the synergistic effect of processing coated webs faster than by using either source separately. During drying the solvent molecule escapes from the coating surface and forms a laminar zone called a boundary zone consisting of a high concentration of the vaporized solvent. The impinging air scrubs and breaks up this laminar zone so that the molecules can be exhausted. Upon escape, the solvent molecules are placed in a high-energy, high-turbulence zone so that separation from the coating is facilitated.

Because of the presence of multiple energy sources and their interaction, the drying oven requires more sophisticated controls than single energy source ovens. In the oven geometry presented, strips of infra-red heaters are arranged with heated air inflow nozzles alongside thereof and with exhaust ports thereabout. As infra-red heaters are most effective when operated at their normal maximum rated temperature, the infra-red elements are, upon cooling by convected air and escaping solvent, interactively overdriven to maintain the maximum rated temperature level. Simultaneously, with a portion of the infra-red radiation being converted to thermal energy, and combined with the high-velocity heated air, the resultant oven temperature rises above the set-point temperature of a high-velocity, heated air oven. To compensate for this, the fuel supply for heating the air is throttled until the predetermined, set-point oven temperature is achieved.

As a result of these control measures, an entirely new method of drying coated webs arises whereby, for given applications, optimization of infra-red radiation and heated air impingement is feasible. Thereby, increased energy usage per unit length of oven results in increased production rates .

It is an object of this invention to provide an efficient and economical device for drying of coated webs, including paper, film, foil, textiles, and metal strips at high production levels.

It is a further object of this invention to provide a hybrid drying oven utilizing both high-velocity heated air and infra-red radiation.

It is a yet further object of this invention to provide a control arrangement for a drying oven which optimizes for given coating application, the utilization of heated and ambient air and infra-red radiation.

It is a still yet further object of this invention to provide a drying oven for continuous webs which maintain drying quality while increasing production rates.

It is a feature of this invention to utilize an infra-red element which may be overdriven to its rated capacity while being cooled by air being reflected from the workpiece together with migrating solvent.

It is another feature of this invention to utilize a combination of gas-fired, impingement air drying and infra-red radiation drying in a manner which increases production rates without impairing coating quality.

Other objects and features of this invention will become apparent upon consideration of the specification appended hereto and disclosed in the drawings which follow.

BRIEF DESCRIPTION OF THE DRAWINGS

In the figures, the same reference numbers are used for the same parts appearing in the various views.

DESCRIPTION OF THE PREFERRED EMBODIMENTS

In the discussion which follows, certain definitions are employed for convenience of the disclosure. First the term "solvent" is broadly used to describe the nonsolid material of coatings, and is applied to both organic solvents and water. The term is used without regard to the solubility of the solids portion of the coating in the solvent. The term "migration" refers to the movement of solvent molecules through the coating.

While the physics of the drying process is not completely understood, the hybrid oven with infra-red energy and impingement of heated air is believed to operate with greater process efficiency and product quality than a single energy source drying oven. According to the present understanding, the infra-red radiation penetrates the coating, excites the solvent molecules in its path, and causes the solvent molecules to move to the surface of the coating. With the hybrid configuration, the impingement air actively clears the surface of the coating and carries the solvent molecules away therefrom. Although the drying of coatings is a phenomenon which is not completely understood, during the development of the hybrid oven described in detail hereinbelow, it has become apparent that the mix of heated convected air and infra-red radiation can be adjusted to optimize drying production rates.

Figure 1:
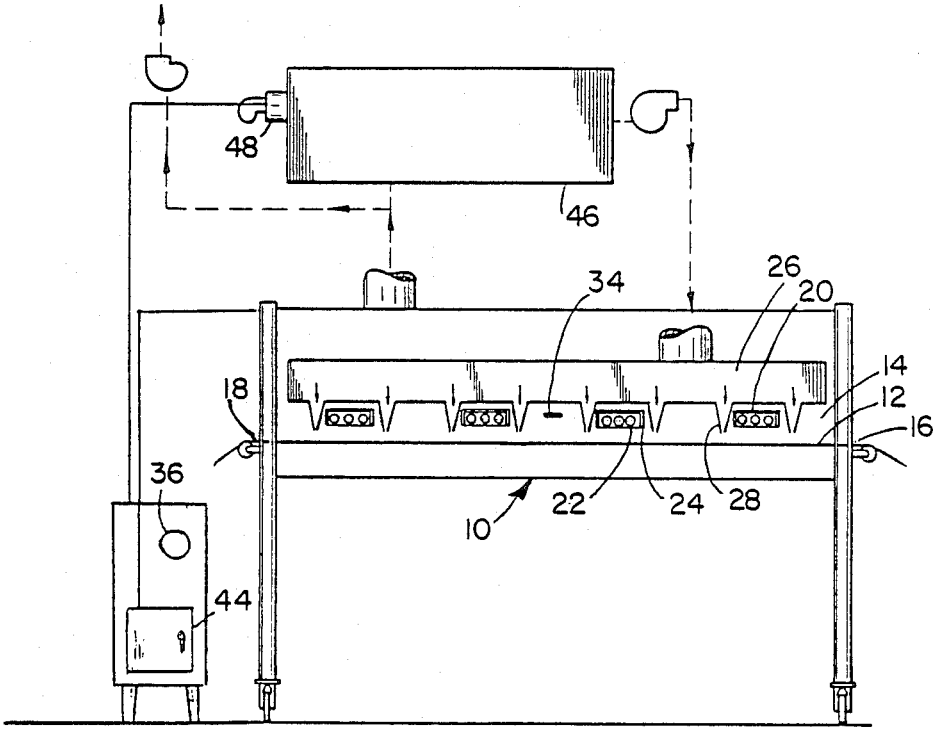
FIG. 1 is a schematic diagram of the hybrid high velocity, hot air impingement oven with infra-red elements of this invention.

Referring now to FIG. 1, the hybrid high-velocity, hot air impingement oven with infra-red elements, referred to generally by reference number 10, is shown in schematic form. In the diagram, the continuous web 12 is shown entering oven chamber 14 through inlet opening 16 and exiting through outlet opening 18. Although the hybrid oven shown herein is described in connection with continuous web applications, the invention disclosed is also applicable to conveyorized drying of materials. Opposite the web or workpiece 12, an array of infra-red heaters 20 with infra-red heating elements 22 are constructed. In the unit shown, the enclosures 24 that surround heaters 20 are positioned in a predetermined manner adjacent one wall of heated air plenum 26. The hybrid high-velocity, hot air impingement oven 10 also includes drying chamber temperature sensor 34 for cooperative functional relationship with a plenum temperature controller 36.

Figure 2:
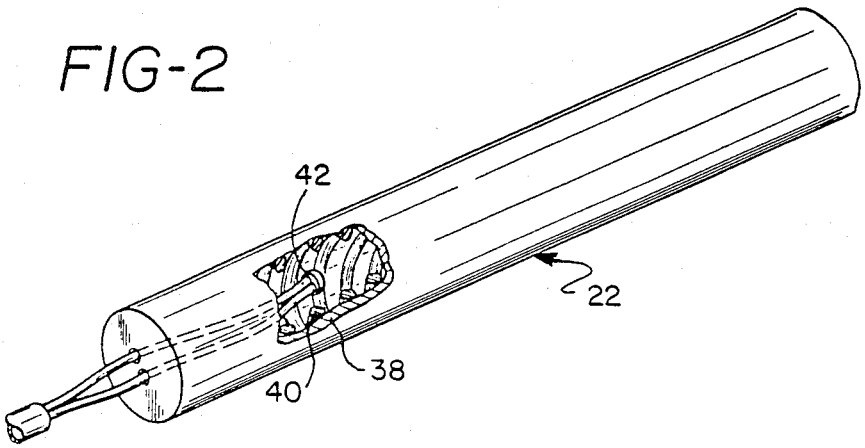
FIG. 2 is a partially broken away, perspective view of an infra-red source showing the sensor embedded therewithin; and, FIG. 3 is a schematic diagram of the drying oven of FIG. 1 shown with associated unwinding, coating, and winding equipment.

Particular attention is now drawn to the infra-red element 22, shown in detail in FIG. 2. For convenience, this element 22 is termed an interactively overdriven infra-red element. The infra-red element 22 is constructed with an outer sheathing covering 38 and a resistance wire 40. Within the covering 38, a temperature sensor or thermocouple 42 is embedded. As will be described in more detail below, the structure provided permits the measurement of the operating temperature of the infra-red element so that when the reflected high velocity heated air (which previously upon impingement has been given up a large quantum of its thermal energy to latent heat of evaporation) tends to cool the infra-red element and thereby reduce its infra-red output, control circuitry supplies higher voltage for maintaining the same infra-red output. In other words, the infra-red element 22 is one characterized as a variable power, constant element temperature, feedback controlled infra-red source. In the particular application, the overdrive infra-red element 22 is controlled by an SCR-controller 44 which, in turn, supplies the feedback demanded power from power source (not shown). Similarly, as the infra-red element 22 contributes thermal energy to the oven chamber 14, the chamber temperature is elevated, is sensed by sensor 34, and is feedback controlled through controller 36. To support this control loop, the air heater 46 is constructed to include a gas supply throttle 48. With this available the fuel supplied to the heater can be controlled to optimize drying.

Figure 3:
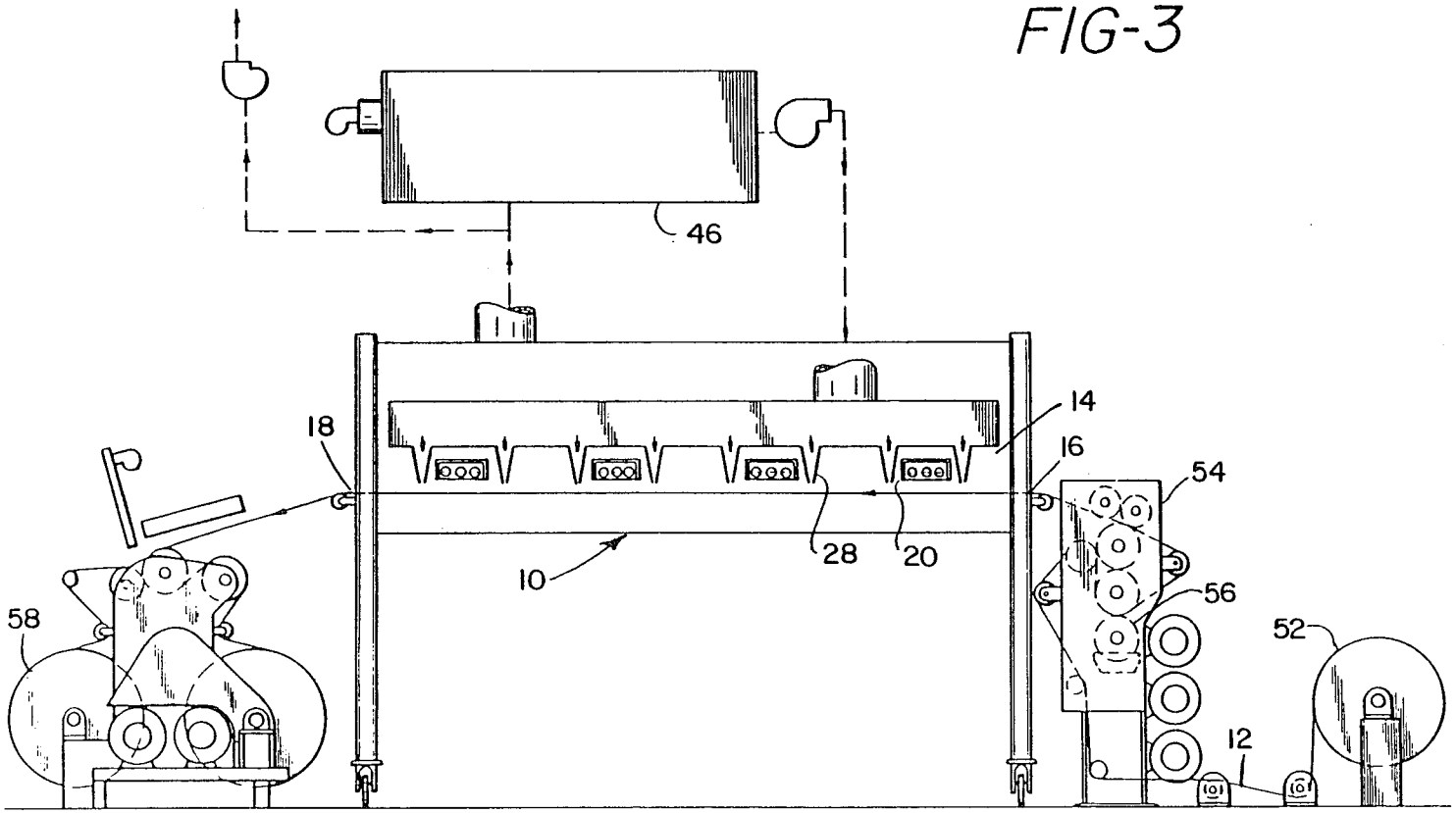

In operation, the utilization of the hybrid oven of this invention is illustrated in FIG. 3 wherein unwinding, coating and schematically represented the oven 10 is shown associated with winding equipment. The equipment is configured with the unwinder 52 providing a continuous web 12 of paper to a reverse roll coater 54 which coater, in turn, applied a coating 56 to the paper. After an approximate 12-foot span, the paper feeds to the oven chamber 14 entering through inlet openings 16 and is transported past the air nozzles 28, and infra-red heaters 20 to outlet opening 18. Thereupon, a span of 10-feet is encountered and a winder 58 takes up the coated and dried paper web. Although the best mode of practicing the invention is shown as applied to a single-sided horizontal drying oven, it is obvious to one skilled in the art that the same elements could be used for webs with coatings on both sides and for vertical tower-type arrangements.

The infra-red elements 22 are rated for normal maximum infra-red output at 80% of line voltage and achieve an element temperature of approximately 1600° F. With line voltage at 240-volt, this corresponds to a 190-volt rated element. The controller, upon the element temperature being sensed below the desired predetermined level supplies voltages of between 190 to 240 volts until the desired temperature is maintained. Other line voltages and elements ratings can be correspondingly accommodated.

The method of drying a coated and continuous web is thus seen from the previous discussion to utilize a hybrid drying oven 10 with a chamber 14 having a gas heater for supplying high-velocity air 30 and a adjustable infra-red source 20 and to comprise the steps of:

(a) conveying said continuous web through said drying chamber;

(b) impinging said heated high velocity air onto said continuous web;

(c) simultaneously with step b., exposing said continuous web to radiation from said adjustable infra-red source at a predetermined element temperature;

(d) cooling the infra-red source by impingement of reflected high velocity air with solvent migrating from the said continuous web;

(e) adjusting the infra-red source to maintain said predetermined element temperature;

1. sensing said element temperature; and,
2. upon cooling by reflected high velocity air from said continuous web automatically driving the infra-red source with the control means therefor at higher power levels to maintain predetermined temperature.

(f) continuously throttling the gas heater to maintain impinging air temperature at a constant level.

1. sensing said impinging air temperature;
2. upon the combined thermal effect of both the heated, high-velocity air and the infra-red source, automatically adjusting the gas supply to maintain impinging air temperature at said constant level.

Where a programmable controller is used for storing drying parameters, for receiving sensed temperatures and for replicating drying conditions, the substeps in the above method (steps e and f, respectively) are changed to accommodate the controller as follows:

e.1. sensing said element temperature;

2. programming the power levels to the infra-red source to predetermine element temperature;

3. upon sensing temperature deviation from predetermined element temperature, automatically overriding the programmed adjustment and driving the infra-red source at power levels to correct said deviation;

f.1. sensing said impinging air temperature;

2. programming the gas supply to the gas heater to predetermine impinging air temperature; and 3. upon sensing temperature deviation from predetermined impinging air temperature, automatically overriding the programmed adjustment and throttling the gas supply to maintain chamber temperature.

What is claimed is:

1. A hybrid oven for the drying of a coating on a continuous web comprising, in combination:

a chamber;

plenum means for collecting and delivering heated air at high velocity adjacent said chamber;

a plurality of air impingement nozzle interconnecting said plenum means and said chamber; directing heating air from the plenum means to the coated continuous web being dried; said air nozzles being disposed at predetermined intervals about the chamber;

one or more controllable infra-red heaters medially disposed between said air nozzles, comprising, in turn;

at least one infra-red element normally operable within a given voltage range;

thermocouple means for providing a control signal relative to the element temperature, said thermocouple means embedded within the outer sheating of said infra-red element; and, infra-red controller means for increasing and decreasing power to said infra-red element, said infra-red controller means capable of providing voltages at levels substantially higher than the upper limit of the rated voltage range for said infra-red element;

whereby, upon said thermal sensor means sensing that said infra-red element is operating at least than the predetermined temperature and is providing less than required infra-red output, the infra-red controller means can provide higher voltages until the predetermined infra-red output is reached.

2. A hybrid oven as described in claim 1 wherein said infra-red controller means provides supply voltages from 0 to 100% of available line voltage; and further wherein said infra-red element is selected for normal maximum operating at approximately 80% of line voltage and for radiating infra-red at a predetermined element temperature.

3. A hybrid oven as described in claim 2 wherein said infra-red controller means is an SCR-controller providing supply voltages from 0 to 240 volts, and said infra-red element normally operable within the 100- to 190-volt range having a normal maximum element temperature of approximately 1600° F. when operating at 190 volts;

whereby, upon said heated air deflecting from the continuous web and cooling the infra-red element to a temperature below the normal maximum infra-red output, the control regimen provides for voltages between 190 volts and 240 volts to maintain the normally anticipated element temperature at 190 volts.

4. A hybrid oven as described in claim 1 further comprising:

air heater means for cooperative functioning with said plenum means providing air at predetermined temperatures;

second thermal sensor means for providing a control signal relative to impingement air temperature;

heated air controller means for throttling fuel supply to said air heater in response to control signal from said second thermal sensor and maintaining impingement air temperatures substantially constant with thermal energy from both heated air and infra-red sources.

5. A hybrid oven as described in claim 1 further comprising:

an entry aperture for receiving incoming continuous web into said oven chamber at one end of said chamber; and, an existing aperture for receiving outgoing continuous web from said oven chamber at the end opposite said entry aperture.

6. A hybrid oven as described in claim 1 wherein said air nozzles are slots formed between spaced apart adjacent infra-red heaters.

7. In infra-red heater with a temperature controller for a hybrid oven utilizing both high velocity air and infra-red sources comprising:

an infra-red element normally operable within a given voltage range;

thermocouple means for monitoring the temperature of said source, said thermocouple means embedded the outer sheathing of said infra-red element; and, temperature control means for cooperative functional relationship with said temperature sensor means, said temperature control means capable of providing voltages at levels substantially higher than said given normal range increasing power to said infra-red element upon decreasing sensed temperature and decreasing power to said infra-red source upon increasing sensed temperature;

whereby, upon convected air impinging on and cooling said infra-red element, the temperature control, the element temperature control means provides higher voltages until the required output is reached.

8. In an infra-red heater with a temperature controller as described in claim 7 wherein said infra-red controller means provides supply voltages from 0 to 100% of available line voltage; and further wherein said infra-red element is selected for normal maximum operating at approximately 80% of line voltage and for radiating infra-red at a predetermined element temperature.

9. In an infra-red heater with a temperature controller as described in claim 7 wherein said infra-red controller means is an SCR-controller providing supply voltages from 0 to 240 volts, and said infra-red element normally operable within the 100-volt to 190-volt range having a normal maximum element temperature of approximately 1600° F. when operating at 190 volts;

whereby, upon said heated air deflecting from the continuous web and cooling the infra-red element to a temperature below the normal maximum infra-red output, the control regimen provides for voltages between 190 volts and 240 volts to maintain the normally anticipated element temperature at 190 volts.

10. A method of drying a continuous web having a solvent-laden coating thereon by utilizing a a hybrid drying chamber having a gas heater for supplying heated high-velocity air and an adjustable infra-red source, element sensor means for detecting element temperature; infra-red source control means for increasing and decreasing supply voltage to said infra-red source; chamber sensor means for detecting chamber temperature; gas-inflow control means for increasing and decreasing the gas supply to said gas heater; and, programmable controller means for storing drying parameters, for receiving sensed temperatures and for replicating drying contitions; said method comprising the steps of:

(a) conveying said continuous web through said drying chamber;

(b) impinging said heated high velocity air onto said continuous web;

(c) simultaneously with step b., exposing said continuous web to radiation from said adjustable infra-red source at a predetermined element temperature;

(d) cooling the infra-red source by impingment of deflected high velocity air with solvent migrating from the said continuous web;

(e) adjusting the infra-red source to maintain said predetermined element temperature;
1. sensing said element temperature;
2. programming the power levels to the infra-red source to predetermine element temperature;
3. upon sensing temperature deviation from predetermined element temperature, automatically overriding the programmed adjustment and driving the infra-red source at power levels to correct said deviation;

(f) continuously throttling the gas heater to maintain air impingement temperature at a constant level;
1. sensing said chamber temperature;
2. programming the gas supply to the gas heater to predetermine impingement air temperature; and
3. upon sensing temperature deviation from predetermined chamber temperature, automatically overriding the programmed adjustment and throttling the gas supply to maintain chamber temperature.

11. A method as described in claim 10 wherein said solvent is water which evaporates from the continuous web during drying.

12. A method as described in claim 11 wherein said infra-red source further comprises:

element sensor means for detecting element temperature; and, infra-red source control means for increasing and decreasing supply voltage to said infra-red source; and wherein, step e., further comprises the substeps of:
1. sensing said element temperature; and,
2. upon cooling by air deflected from said continuous web automatically driving the infra-red source with the control means therefor at higher power levels to maintain predetermined temperature.

13. A method as described in claim 10 wherein said hybrid drying chamber further comprises:

chamber sensor means for detecting chamber temperature; and, gas-inflow control means for increasing and decreasing the gas supply to said gas heater; and wherein, step f., further comprises the substeps of:
1. sensing said chamber temperature; and
2. upon the combined thermal effect of both the heated, high-velocity air and the infra-red source, automatically adjusting the gas supply to maintain impingement air temperature at said constant level.

14. A method as described in claim 10 wherein said hybrid drying chamber further comprises:

element sensor means for detecting element temperature; and, infra-red source control means for increasing and decreasing supply voltage to said infra-red source;

chamber sensor means for detecting chamber temperature; and, gas-inflow control means for increasing and decreasing the gas supply to said gas heater;

programmable controller means for storing drying parameters, for receiving sensed temperatures and for replicating drying conditions;

wherein, step e., further comprises the substeps of:
1. sensing said element temperature;
2. programming the power levels to the infra-red source to predetermine element temperature;
3. upon sensing temperature deviation from predetermined element temperature, automatically overriding the programmed adjustment and driving the infra-red source at power levels to correct said deviation;

wherein, step f., further comprises the substeps of:
1. sensing said chamber temperature;
2. programming the gas supply to the gas heater to predetermine impingement air temperature; and
3. upon sensing temperature deviation from predetermined chamber temperature, automatically overriding the programmed adjustment and throttling the gas supply to maintain chamber temperature.

* * * * *